United States Patent [19]

Crisci

[11] Patent Number: 4,658,977

[45] Date of Patent: Apr. 21, 1987

[54] SNAP ON TWIST OFF TAMPER-PROOF CLOSURE FOR CONTAINERS

[75] Inventor: Robert E. Crisci, New Castle, Pa.

[73] Assignee: (Nepco) Northern Eng. & Plastics Corp., New Castle, Pa.

[21] Appl. No.: 789,712

[22] Filed: Oct. 21, 1985

[51] Int. Cl.[4] ..... B65D 41/48

[52] U.S. Cl. ..... 215/256; 215/341; 215/DIG. 1

[58] Field of Search ..... 215/256, 254, 344, DIG. 1

[56] References Cited

U.S. PATENT DOCUMENTS

| | | | |
|---|---|---|---|
| 3,392,860 | 7/1968 | Faulstich | 215/256 |
| 3,812,994 | 5/1974 | Feldman | 215/256 |
| 3,893,583 | 7/1975 | McLaren | 215/256 |
| 3,907,146 | 9/1975 | Fields | 215/344 X |
| 3,979,002 | 9/1976 | Faulstich | 215/256 |
| 4,089,463 | 5/1978 | Babiol | 215/344 X |
| 4,166,552 | 9/1979 | Faulstich | 215/256 |
| 4,561,553 | 12/1985 | Crisci | 215/256 |

FOREIGN PATENT DOCUMENTS

| | | | |
|---|---|---|---|
| 611668 | 10/1956 | Fed. Rep. of Germany | 215/256 |

*Primary Examiner*—Donald F. Norton
*Attorney, Agent, or Firm*—Harpman & Harpman

[57] ABSTRACT

A flexible closure for a container, such as a blow molded jug, having a neck portion with an inturned flexible flange surrounding an opening therein and a pair of vertically spaced fastening configurations on the exterior thereof; the closure having a cap portion with an annular depending flange on its peripheral edge and at least one depending annular flexible sealing flange inwardly thereof for engagement with said inturned flange on said neck portion. A tear skirt is removably attached to the annular depending flange, the tear skirt having a pull tab for the removal thereof. An out-turned annular flange is formed on said tear skirt and a plurality of circumferencially placed gussets join said angular flange and said tear skirt. The closure has dual fastening configurations, either one of which is capable of holding the closure on the neck portion of the container. When the tear skirt of the closure is removed the opposite sides of the depending flange of the flexible closure may be moved inwardly to engage ribs on the neck portion so that twisting the closure removes it and the annular sealing flange from the neck of the container.

8 Claims, 8 Drawing Figures

SNAP ON TWIST OFF TAMPER-PROOF CLOSURE FOR CONTAINERS

BACKGROUND OF THE INVENTION

1. Technical Field

This invention relates to tamper-proof closures for containers, such as blow molded plastic jugs which are widely used in the dairy industry for the expendible packaging of dairy products, such as milk.

2. Description of the Prior Art

Prior closures of this type may be seen in U.S. Pat. Nos. 3,392,860, 3,893,583 and 3,979,002.

The present invention provides a dual fastening molded plastic tamper-proof snap-on twist off closure that includes a top portion with a depending annular ribbed flange having a first fastening configuration therein with a second fastening configuration forming a frangible connection with a tear skirt depending from the annular ribbed flange. Partial thread-like configurations in the closure and on the neck of the container which receives it are engaged when the sides of the closure are distorted inwardly so that twisting the closure removes it. An annular depending sealing flange on the closure engages an inturned flexible flange on the container defining the opening therein.

SUMMARY OF THE INVENTION

A tamper-proof closure for a container such as a blow molded jug with appropriate neck configurations takes the form of a cap portion having a top with a ribbed annular depending flange on its peripheral edge and a depending flexible annular sealing flange spaced inwardly thereof. An inturned fastening flange is formed on the inner surface of the ribbed annular depending flange of the cap portion adjacent an area of larger diameter in which an annular groove is formed in the inner surface thereof so as to define a second fastening configuration and a thin frangible wall connection with a depending annular tear skirt. A pull tab is integrally formed with a tear skirt and a vertical groove is formed in the tear skirt adjacent the pull tab. The depending flexible annular sealing flange is positioned for sealing registry with the upper surface of a flexible inturned flange on the neck portion of the container.

DESCRIPTION OF THE PREFERRED EMBODIMENT

Figure 4:
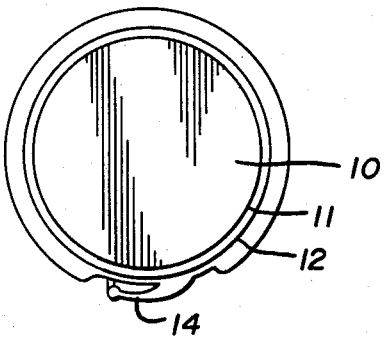
FIG. 4 is a top plan view of the snap on twist off tamper-proof closure showing the pull tab.
Figure 5:
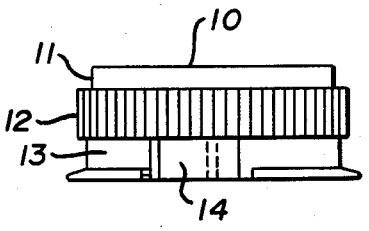
FIG. 5 is a side elevation of the snap on twist off tamper-proof closure showing the pull tab and the ribbed flange above the tear skirt.

By referring to the drawings and FIGS. 4 and 5 in particular, a top plan view and a side elevation of the snap on twist off tamper-proof closure may be seen, the closure including a top portion 10 with a depending annular ribbed flange 12 joined by a frangible thin wall to a tear skirt 13, the lower edge of which has an outturned angular flange formed on a majority of its annular edge. A pull tab 14 is attached to the tear skirt 13 in the area between the ends of the outturned angular flange.

As illustrated in FIG. 5 of the drawings, the ribbed flange 12 and the tear skirt 13 are of larger diameter than an upper portion 11 of the closure. The tear skirt 13 extends alongside the end of the pull tab 14 and is provided with a vertical tear groove as shown in broken lines.

Figure 1:
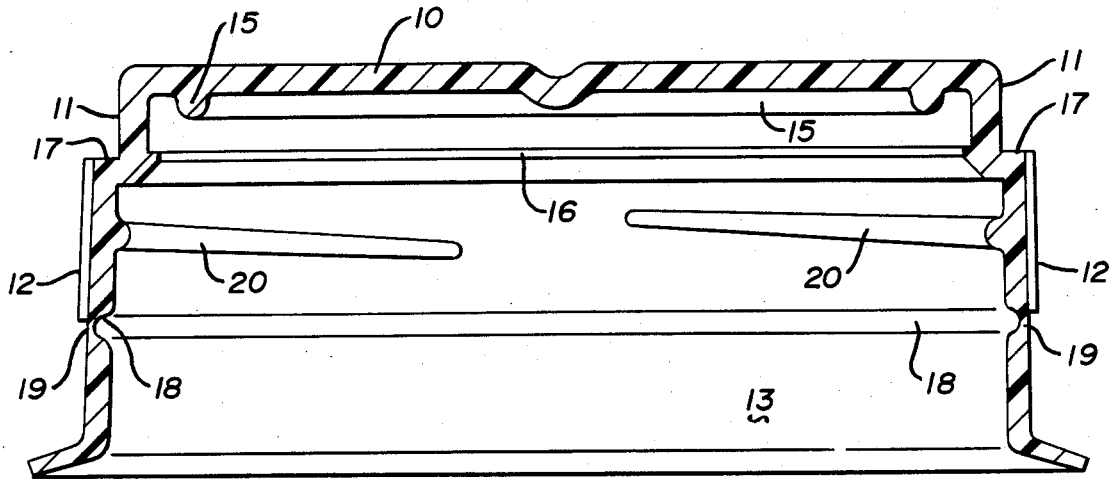
FIG. 1 is a vertical section of the snap on twist off tamper-proof closure.

By referring to FIG. 1 of the drawings, an enlarged vertical section of the snap on twist off tamper-proof closure may be seen to comprise the circular flat top portion 10, the relatively short upper portion 11 of the depending annular ribbed flange 12 and the frangibly attached tear skirt 13. It will be observed that there is an annular flexible sealing flange 15 that depends from the circular flat top portion 10 spaced inwardly from the upper portion 11 of the depending annular ribbed flange 12. The upper portion 11 will be observed to be of smaller diameter than the lower portion of the depending annular ribbed flange 12 and it is provided with an inturned flange 16 that forms a first fastening configuration. A shoulder 17 defines the difference in diameters of the upper portion 11 and the lower portion of the annular ribbed flange 12, the inturned annular fastening flange 16 being located almost directly inwardly of the shoulder 17. The exterior ribbed annular surface of the annular ribbed flange 12 below the shoulder 17 is formed on a substantially vertical plane. The depending annular ribbed flange 12 is formed in a decreased wall thickness with respect to the wall thickness of the upper portion 11 thereof and the circular flat top portion 10 of the snap on twist off tamper-proof closure so that it may be distorted inwardly by pressure applied to its outer opposite sides as may be seen by the broken line illustration in FIG. 3 of the drawings.

There is an inner annular groove 18 at the bottom edge of the annular ribbed flange 12, the annular groove 18 being sufficiently deep that it creates a thin, frangible connecting wall 19 and thereby defines the tear skirt 13 which is positioned therebelow.

Figure 2:
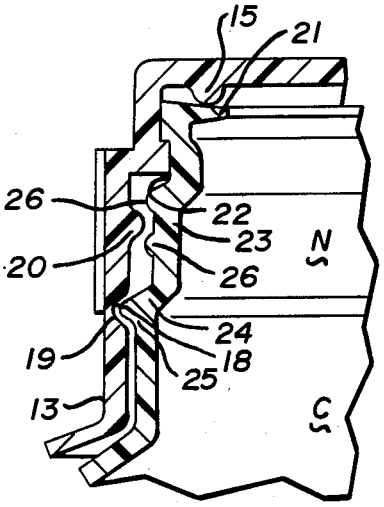
FIG. 2 is vertical section through a portion of the snap on twist off tamper-proof closure and a portion of a neck of a container on which the closure is applied showing the engagement of the depending annular flexible sealing flange on the neck of the container.

The inner annular groove 18 forms a second snap in fastening configuration between the closure and the neck of the container as seen in FIG. 2 of the drawings.

Still referring to FIG. 2 of the drawings, a portion of a container C having a neck N may be seen, the configuration of the neck N having an inturned flexible tapered top flange 21 defining the opening to the container, an annular flat shallow groove 22 on the exterior of the neck N is spaced downwardly with respect to the upper end of the neck portion of the container, an annular flat wall section 23 immediately therebelow, the lower portion of which joins an outwardly angling section 24 which extends into an annular rib 25. The annular rib 25 and the flat shallow groove 22 of the neck portion N of the container form two fastening configurations which register with the annular groove 18 and the inturned fastening flange 16 respectively of the snap on twist off tamper-proof closure. It will be seen that simply pushing the closure downwardly on the neck N of the container C brings the dual fastening configurations just described into interlocking relation thus securely positioning the closure on the container neck. At the same time the depending annular flexible sealing flange 15 on the closure sealingly engages the inclined annular area defined by the tapered top flange 21 of the neck N of the container around the opening therein.

Figure 3:
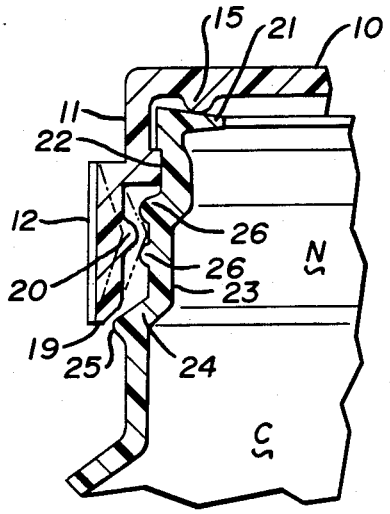
FIG. 3 is a vertical section through a portion of the snap on twist off tamper-proof closure after the tear skirt has been removed and showing the same on a portion of the neck of a container in sealing relation. Broken lines in FIG. 3 show the distortion of the closure to engage the twist off thread configurations.

By referring now to FIG. 3 of the drawings, a vertical section of a portion of the container C and the neck N thereof may be seen with the upper portion 11 of the snap on twist off tamper-proof closure repositioned thereon in sealing relation. In FIG. 3 of the drawings, the tear skirt 13 has been removed leaving the flat top 10 with the first top portion 11 thereon including the shoulder 17 and the inturned fastening flange 16 which is illustrated in engagement with the upper portion of the flat shallow groove 22 of the neck portion N. The sealing engagement of the depending annular sealing flexible flange 15 with the upper surface of the tapered inwardly extending top flange 21 of the neck portion N being maintained. The engagement of the inturned fastening flange 16 of the closure with the upper portion of the flat shallow groove 22 of the neck portion N is sufficient to hold the closure on the container as shown in FIG. 3 at all times including dropping the container of a one-gallon size filled with liquid, such as milk, on a hard surface, such as a floor, from an elevated height. The spacing of the fastening configurations thus defined to the depending annular flexible sealing flange 15 permits the distortion of the closure and the flanges 15 and 21 and thus insures a liquid tight seal which is so highly desirable when the closure in its abbreviated form is replaced on the container.

Referring again to FIG. 1 of the drawings, it will be seen that two circumferentially spaced thread-like angular ribs 20 are formed on the inner surface of the annular ribbed flange 12 of the closure, each rib 20 extending substantially 40% of the circumference of the closure. It will thus be seen that the annular ribbed flange 12 in which the ribs 20 are formed can be moved inwardly by pressure applied to the opposite sides of the closure so that the ribs 20 will engage a pair of similarly shaped thread-like annular ribs 26 formed on the neck N of the container C whereupon twisting rotary motion applied to the closure will remove it from the neck of the container.

It will be seen that when the snap on twist off tamper-proof closure disclosed herein is positioned downwardly on the neck of a container such as a blow molded plastic jug, the dual fastening configurations snap into position simultaneously and without interfering with one another as the closure is moved downwardly over the neck N of the container and the sealing flanges 15 and 21 engaged. All of the depending annular ribbed flange 12 and the ribs 20 thereon are spaced outwardly or radially of the flat shallow groove 22 and the annular flat wall 23 and the ribs 26 on the neck portion N of the container so that they do not engage the same, but move downwardly freely until the annular groove 18 which forms the second fastening configuration registers with the annular rib 25 on the neck portion N of the container. Simultaneously, the upper portion of the closure has moved downwardly until the inturned annular fastening flange 16 snaps inunder the portion of the neck N defining the upper part of the flat shallow groove 22.

The material of the closure beneath the shoulder 17 and substantially opposite the inturned annular fastening flange 16 insures the effective and tight snap in arrangement of the inturned fastening flange 16 in the upper portion of the flat shallow groove 22 of the neck portion N.

The closure is formed of resilient, molded, plastic material.

It will occur to those skilled in the art that in order to remove the closure from the neck of the container, it is necessary to grasp the pull tab 14, as shown in FIG. 4 of the drawings, and move it from left to right which causes the tear skirt 13 to separate on the line of the groove 18 which is formed in the inner surface of the ribbed flange 12 as hereinbefore described. The tear skirt 13 is thus removed completely from the closure leaving the remaining portion of the closure as seen in FIG. 3 complete with its first fastening means intact upon the neck N of the container. The remaining portion of the closure, which is the top 10, the upper portion 11, of the annular ribbed flange 12, as seen in FIG. 3 of the drawings, is then removed by moving the sides of the ribbed flange 12 inwardly toward one another to engage the ribs 20 and 26 and twisting the closure in a rotary motion. This lifts the closure and frees the first fastening configuration and breaks the seal of the depending annular flexible sealing flange 15 with the inturned flange 21 of the container.

Figure 6:
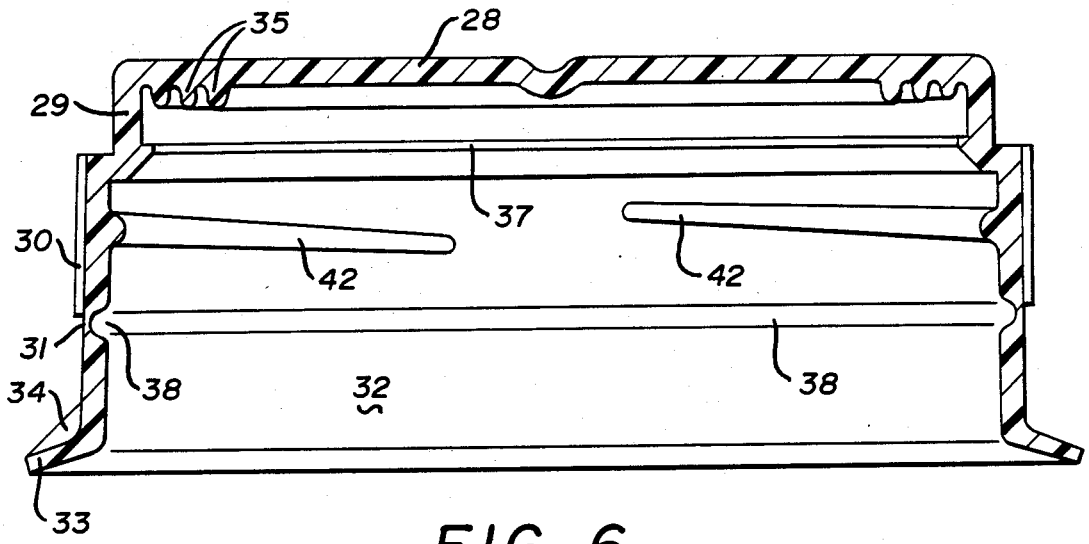
FIG. 6 is a vertical section of a modified closure having several flexible sealing flanges.
Figure 7:
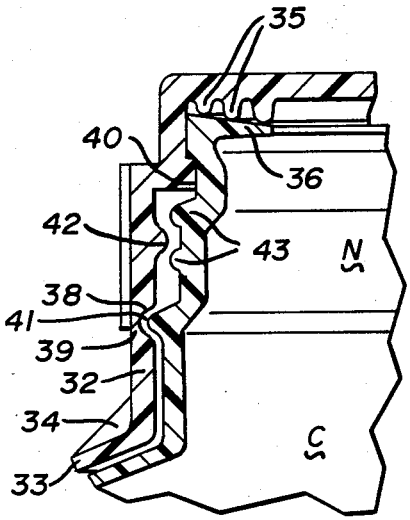
FIG. 7 is a vertical section through a portion of the modified closure on the neck of a container.
Figure 8:
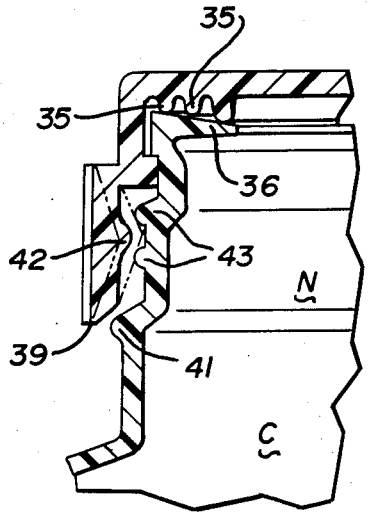
FIG. 8 is a vertical section of the modified closure on the neck of a container with the tear skirt removed.

A modification of the closure may be seen in FIGS. 6, 7 and 8 of the drawings wherein a closure including a top portion 28 with a relative short upper portion 29 of a depending annular flange 30 has a frangible thin wall 31 joining a tear skirt 32 the lower edge of which has an outturned angular flange 33. Circumferentially spaced gussets 34 join the flange 33 and tear skirt 32 and maintain the position of the flange 33 when the closure is stripped from the mold. Several depending annular flexible sealing flanges 35 are formed on the lower inner surface of the top 28 for sealing engagement with the upper surface of an inturned inclined annular flange 36 which may be tapered, as seen in FIGS. 7 and 8. The several depending annular flexible sealing flanges 35 on the closure top portion 28 with the resilient elastic top portion 28 of the closure form a plurality of annular seals on the registering inclined flange 36 of a blow molded container or bottle. The depending annular flexible sealing flanges 35 are of different diameters and depend from the top portion 28 of the closure in different lengths. The closure seen in FIGS. 6, 7 and 8 has the same novel dual fastening means for engaging registering dual fastening means on the neck of a container or bottle as hereinbefore described in connection with FIGS. 1, 2, 3, 4 and 5 of the drawings.

These dual fastening means on the closure comprise an inturned flange 37 and an inwardly facing groove 38 which also defines the frangible thin wall 39. The flange 37 and groove 38 register with a shallow groove 40 and annular rib 41 respectively on the neck N of a container C as seen in FIGS. 7 and 8 of the drawings.

In FIGS. 6, 7 and 8 a pair of circumferentially spaced thread like annular ribs 42 on the inside of the resilient depending flange 30 of the closure can be moved inwardly by pressure applied to the opposite sides of the closure so that the ribs 42 engage similarly shaped annular ribs 43 on the neck N of the container C so that twisting rotary motion applied to the closure will remove it from the neck N of the container.

It will thus be seen that the snap on twist off tamperproof closure for containers disclosed herein has novel fluid sealing means with respect to the closures heretofore known in the art and in particular those which are primarily adapted for use on blow molded plastic jugs such as used in the dairy industry for the packaging of milk and similar liquid products.

Having thus disclosed my invention, what I claim is:

1. In a resilient molded plastic closure for a container of the type having a neck surrounding an opening to the container defined by an inturned flange having upper and lower surfaces and having dual closure retaining means on said neck; said closure comprising means for covering said opening to said container and a depending annular flange surrounding said neck; said depending flange having dual means for engaging said retaining means, one of said dual means comprising an annular groove forming a frangible wall positioned in the inner surface of said depending annular flange, the portion of the depending flange below said annular groove defining a tear skirt, said tear skirt having a pull tab affixed thereto, said means for covering said opening to said container comprising a resilient elastic top portion having said depending annular flange joined thereto at the peripheral edge of said top portion, circumferencially positioned thread like ribs on the inner surface of said depending flange above said annular groove, said closure retaining means on said neck including circumferentially positioned thread like ribs, said thread like ribs on said depending annular flange being engageable with said thread like ribs on said neck only when said portions of said depending annular flange are moved inwardly toward one another, the combination therewith of; at least one annular flexible sealing flange integrally formed on the means for covering said opening in depending relation thereto and the position for sealing relation with said upper surface of said inturned annular flange on said container.

2. The improvement in a closure for a container set forth in claim 1 and wherein there are at least two depending annular flexible sealing flanges formed on said means covering said opening to said container and positioned inwardly of said first mentioned depending annular flange for registry with said upper surface of said inturned annular flange on said container.

3. The improvement in a closure for a container set forth in claim 1 and wherein said depending annular flange is formed in two diameters, one of which is smaller than the other and is adjacent said means for covering said opening and wherein one of said dual means on said closure for engaging said dual closure retaining means on said neck is located on said smaller diameter depending annular flange and wherein said annular groove forming said frangible wall is located in the larger diameter of said depending annular flange.

4. The improvement in a closure for a container set forth in claim 1 and wherein there are several depending annular flexible sealing flanges each being of a different diameter and spaced with respect to one another.

5. The improvement in a closure for a container set forth in claim 1 and wherein there are several depending annular flexible sealing flanges each being of a different depending dimension with respect to one another.

6. The improvement in a closure set forth in claim 1 wherein there are several depending annular flexible sealing flanges of graduated dimensional sizes, the largest of which is closely spaced to the depending annular flange and each of said depending annular flexible sealing flanges are of graduated depending dimensions greater than their width with the sealing flanges having the smallest of the graduated depending dimensions being adjacent said depending annular flange.

7. The improvement in a closure set forth in claim 1 wherein there are a plurality of gussets fixed to said tear skirt at locations that are spaced circumferentially from each other on said tear skirt.

8. The improvement in a closure set forth in claim 7 wherein an outturned angular flange is joined to said tear skirt and said gussets are joined to said outturned angular flange.

* * * * *